US009873205B2

(12) United States Patent
Toy et al.

(10) Patent No.: US 9,873,205 B2
(45) Date of Patent: Jan. 23, 2018

(54) ELECTRIC GROOMING APPLIANCE

(71) Applicant: Spectrum Brands, Inc., Middleton, WI (US)

(72) Inventors: David Yet Toy, Madison, WI (US); Paul Allen Schmitt, Madison, WI (US); Timin Ahmad Musallam, Sun Prairie, WI (US)

(73) Assignee: Spectrum Brands, Inc., Middleton, WI (US)

( * ) Notice: Subject to any disclaimer, the term of this patent is extended or adjusted under 35 U.S.C. 154(b) by 155 days.

(21) Appl. No.: 14/749,367

(22) Filed: Jun. 24, 2015

(65) Prior Publication Data

US 2015/0367521 A1 Dec. 24, 2015

Related U.S. Application Data

(60) Provisional application No. 62/016,336, filed on Jun. 24, 2014.

(51) Int. Cl.
*B26B 19/38* (2006.01)

(52) U.S. Cl.
CPC ..... *B26B 19/3846* (2013.01); *B26B 19/386* (2013.01); *B26B 19/388* (2013.01)

(58) Field of Classification Search
CPC ..... B26B 19/382; B26B 19/3826; B26B 19/3846; B26B 19/386; B26B 19/388; B26B 19/48
See application file for complete search history.

(56) References Cited

U.S. PATENT DOCUMENTS 3,141,239 A * 7/1964 Meyer ..... B26B 19/40 30/34.05
3,364,568 A * 1/1968 Lowy ..... B26B 19/40 219/531
3,390,018 A * 6/1968 Habdas ..... H01L 35/30 136/204
3,817,043 A * 6/1974 Zoleta ..... B60H 1/00478 219/208
6,271,459 B1 * 8/2001 Yoo ..... H01L 35/00 136/201
6,314,648 B1 * 11/2001 Hillebrandt ..... B26B 19/10 30/208
7,490,409 B2 * 2/2009 Oh ..... B26B 19/04 30/346.51
7,587,902 B2 * 9/2009 Bell ..... F02G 1/043 62/3.2
8,136,250 B2 * 3/2012 Floessholzer ..... B26B 19/06 30/346.51
8,141,254 B2 * 3/2012 Shimizu ..... B26B 19/10 30/43

(Continued)

FOREIGN PATENT DOCUMENTS

WO WO 2015/200520 A1 * 12/2015

*Primary Examiner* — Hwei C Payer
(74) *Attorney, Agent, or Firm* — Armstrong Teasdale LLP

(57) ABSTRACT

A grooming appliance generally includes a handle and a grooming head attached to the handle. The grooming head generates heat during operation of the appliance. The grooming appliance further includes a cooling system disposed at least in part within the handle. The cooling system has a thermoelectric cooling device for removing heat from the grooming head during operation of the appliance.

20 Claims, 10 Drawing Sheets

(56) References Cited

U.S. PATENT DOCUMENTS

| | | | | |
|---|---|---|---|---|
| 8,555,510 | B2 * | 10/2013 | Fuerst | A45D 27/46 30/43.91 |
| 9,006,556 | B2 * | 4/2015 | Bell | F01P 9/06 136/205 |
| 2002/0052611 | A1 * | 5/2002 | Inoue | A45D 26/0028 606/133 |
| 2006/0254638 | A1 * | 11/2006 | Carmeli | H01L 35/00 136/205 |
| 2009/0049694 | A1 * | 2/2009 | Morris | B26B 19/382 30/43.6 |
| 2012/0192436 | A1 * | 8/2012 | Toy | B26B 19/06 30/216 |
| 2012/0233865 | A1 * | 9/2012 | Kammer | B26B 19/3846 30/201 |
| 2013/0192068 | A1 * | 8/2013 | Kammer | B26B 19/386 30/43.9 |
| 2014/0290452 | A1 * | 10/2014 | Burghardt | B26B 19/388 83/15 |
| 2015/0251325 | A1 * | 9/2015 | Teteak | B26B 19/386 30/228 |
| 2015/0367521 | A1 * | 12/2015 | Toy | B26B 19/3846 30/123 |
| 2016/0327314 | A1 * | 11/2016 | Langsdorf | B26B 19/382 |
| 2016/0361826 | A1 * | 12/2016 | Musallam | B26B 19/04 |

* cited by examiner

ELECTRIC GROOMING APPLIANCE

CROSS-REFERENCE TO RELATED APPLICATIONS

This application claims the benefit of U.S. Provisional Application No. 62/016,336 filed on Jun. 24, 2014, which is incorporated by reference herein in its entirety.

BACKGROUND

The present invention relates generally to grooming appliances and, more particularly, to electric hair cutting or plucking appliances.

Some conventional electric grooming appliances (e.g, electric hair trimmers and shavers) include a handle and a blade set attached to the handle. The blade set has a stationary blade and a movable blade arranged in sliding, face-to-face contact with the stationary blade. A hair cutting operation is performed by driving the movable blade back-and-forth relative to the stationary blade as the stationary blade is moved over the skin such that hair entering the stationary blade is cut.

In such an arrangement, the movable blade is typically biased against the stationary blade to maintain the contact between the movable blade and the stationary blade. As a result, increasing the biasing force imparted to the movable blade has been known to improve cutting effectiveness. However, the increased biasing force may also yield an increase in friction between the blades and, therefore, an increase in heat generated by the blades. This increase in heat may result in discomfort to the user, as well as deformation of the blades over time.

There is a need, therefore, for an electric grooming appliance configured for effectively removing heat from its blade set.

SUMMARY

In one embodiment, a grooming appliance generally comprises a handle and a grooming head disposed on the handle. The grooming head generates heat during operation of the appliance. The grooming appliance further comprises a cooling system disposed at least in part within the handle. The cooling system comprises a thermoelectric cooling device for removing heat from the grooming head during operation of the appliance.

In another embodiment, an electric hair grooming appliance generally comprises a handle, a motor housed within the handle, and a head disposed on the handle. The head comprises a blade set having a plurality of blades that cooperate to remove hair. At least one of the blades is operatively connected to the motor. The appliance further comprises a cooling system disposed at least in part within the handle. The cooling system comprises a thermoelectric cooling device for removing heat from the blade set during operation of the appliance.

In yet another embodiment, an electric hair grooming appliance generally comprises a handle, a motor housed within the handle, and a head detachably connected to the handle. The head comprises a blade set and a blade cartridge configured to support the blade set on the handle. The blade set includes a toothed stationary blade and a toothed movable blade arranged in sliding, face-to-face contact with the stationary blade. The blade cartridge comprises a blade frame to which the stationary blade is fastened, and a drive member on which the movable blade is seated. The drive member has a follower configured to drive the movable blade into oscillation when the appliance is operated. The blade cartridge further includes a biasing assembly configured to bias the movable blade and the drive member toward the stationary blade. The biasing assembly comprises a spring and a blade support seated on the spring for engaging the movable blade and guiding oscillation of the movable blade such that the movable blade, the drive member, and the biasing assembly are secured between the stationary blade and the blade frame. The appliance also comprises a cooling system including a heat sink and a Peltier device situated in conductive heat transfer with the heat sink and with at least one of the motor and the blade set such that the Peltier device is configured to transfer heat from the at least one of the motor and the blade set to the heat sink during operation of the appliance.

BRIEF DESCRIPTION

Corresponding reference characters indicate corresponding parts throughout the several views of the drawings.

DETAILED DESCRIPTION

Figure 1:
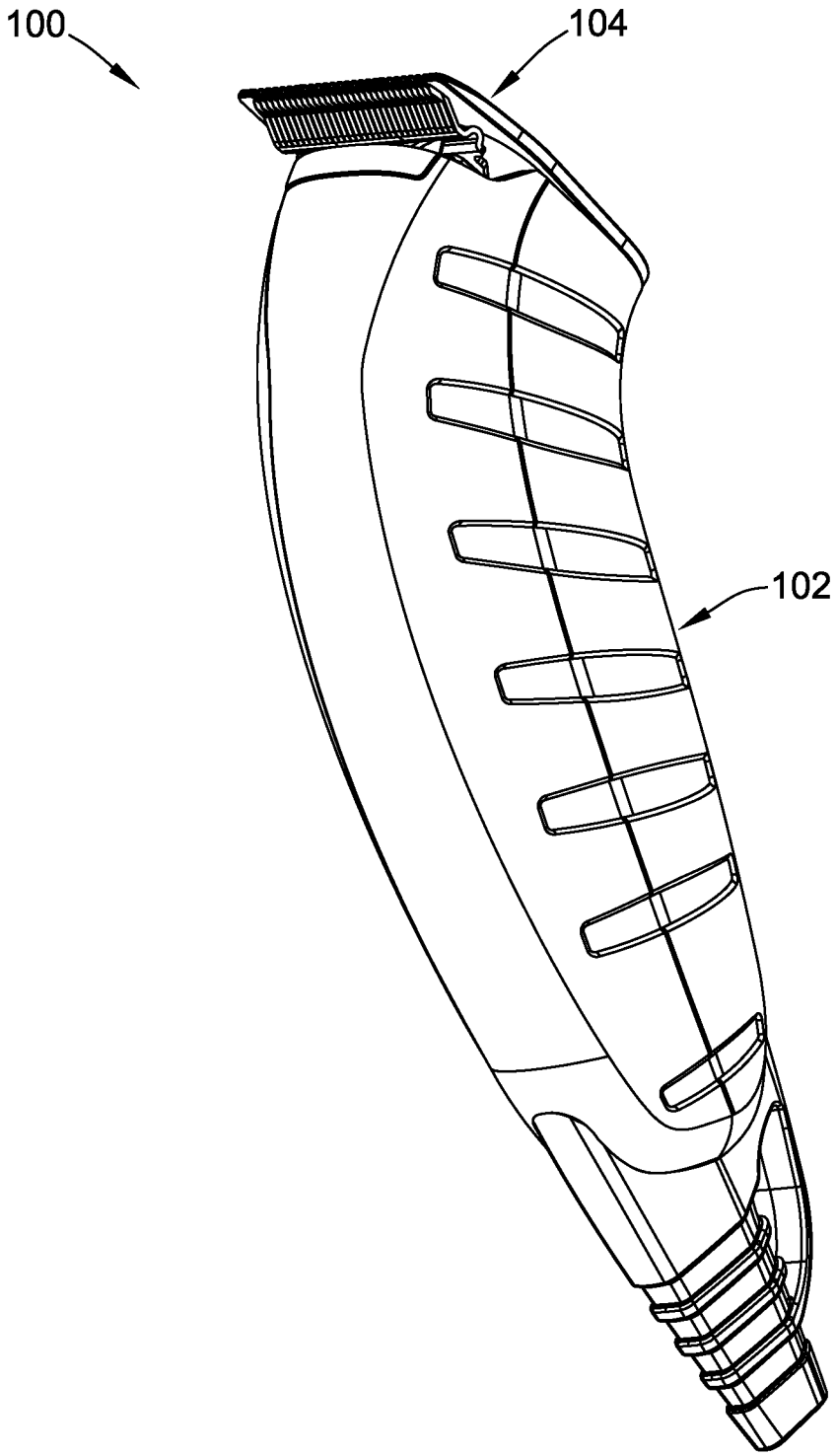
FIG. 1 is a perspective view of one embodiment of an electric hair grooming appliance.
Figure 2:
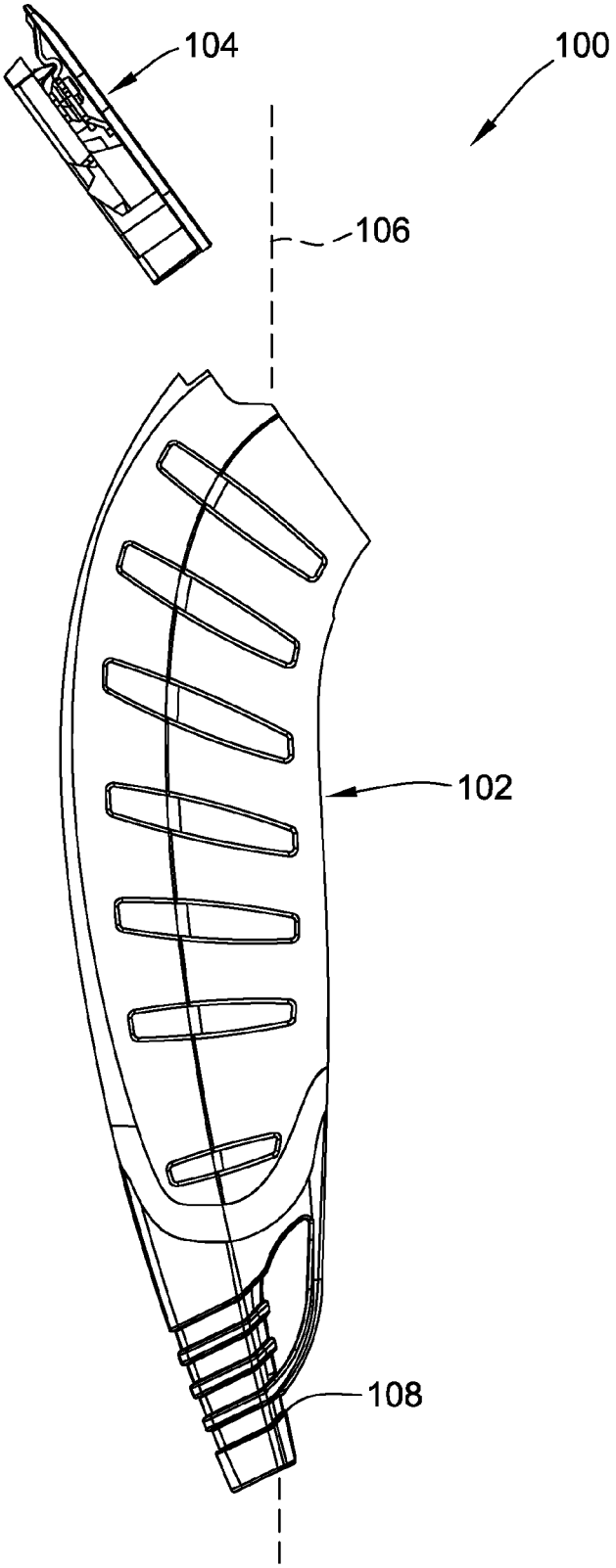
FIG. 2 is a side view of the appliance of FIG. 1 with its head detached from its handle.

Referring now to the drawings, and in particular to FIGS. 1 and 2, an electric hair grooming appliance according to one embodiment (namely, an electric trimmer embodiment) is indicated generally by the reference numeral 100. It is understood, however, that other suitable embodiments of hair grooming appliances (e.g., shavers, epilators, etc.) are also contemplated without departing from the scope of this invention.

The illustrated appliance 100 comprises a handle, generally indicated at 102, and a head, generally indicated at 104, detachably connected to the handle 102. The handle 102 has a longitudinal axis 106, and houses circuitry (e.g., a control unit such as a microprocessor, memory, and associated wiring) for controlling the various functions of the appliance 100. Accessible by a user on an exterior of the handle 102 is a user interface (e.g., a power switch) for interacting with the appliance 100, and a power connector (e.g., a cord 108) for providing power to the appliance 100. Optionally, the handle 102 in some embodiments may house any suitable operating components of the appliance 100 (e.g., a battery such that the appliance 100 is configured for corded and/or cordless operation), and the head 104 in some embodiments may not be detachable from the handle 102.

Figure 3:
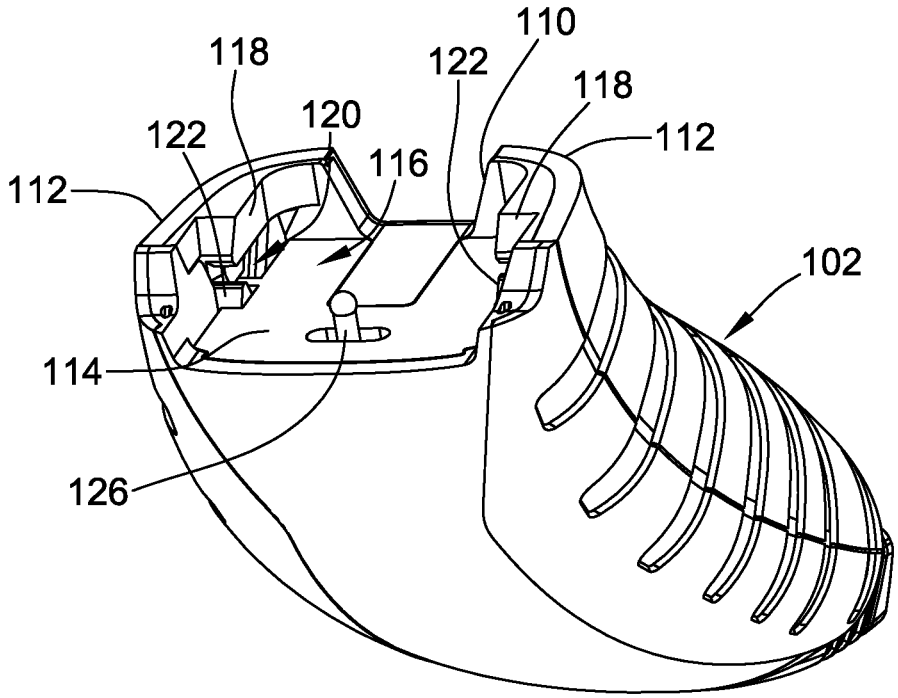
FIG. 3 is perspective view of the handle of FIG. 2.

With reference to FIG. 3, the handle 102 includes a head attachment structure, namely a neck 110 that receives the head 104 for attaching the head 104 to the handle 102. The neck 110 has a pair of opposing side walls 112 that protrude from a base 114 to at least partially surround a pocket 116 into which the head 104 is inserted, and each side wall 112 has a ledge 118 that interfaces with the head 104 upon attachment of the head 104 to the handle 102. In this manner, each side wall 112 forms a channel 120 between the base 114 and the respective ledge 118.

Figure 4:
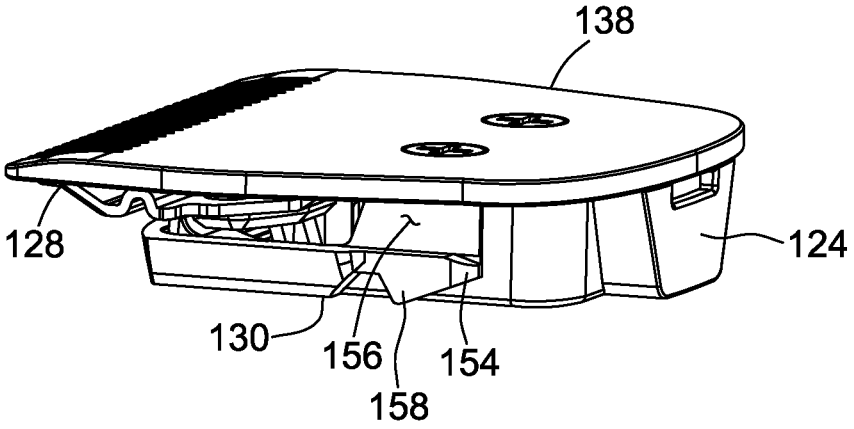
FIG. 4 is a perspective view of the head of FIG. 2.
Figure 5:
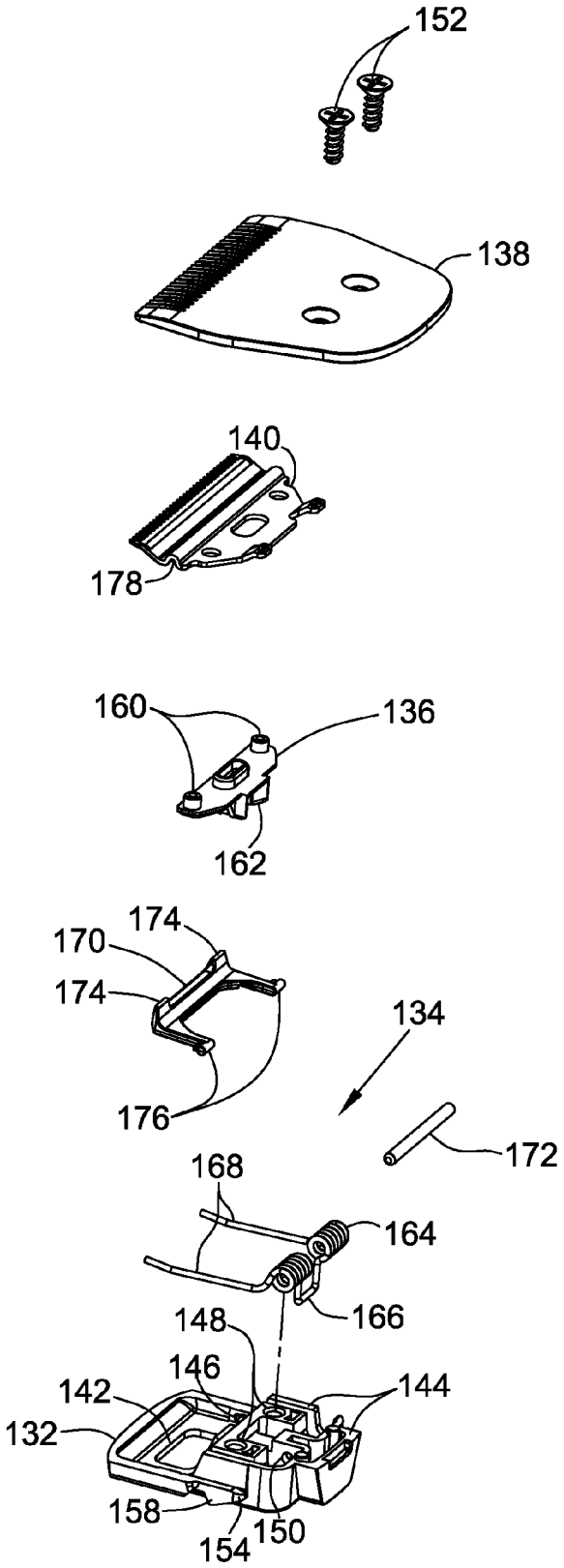
FIG. 5 is an exploded view of the head of FIG. 4.
Figure 6:
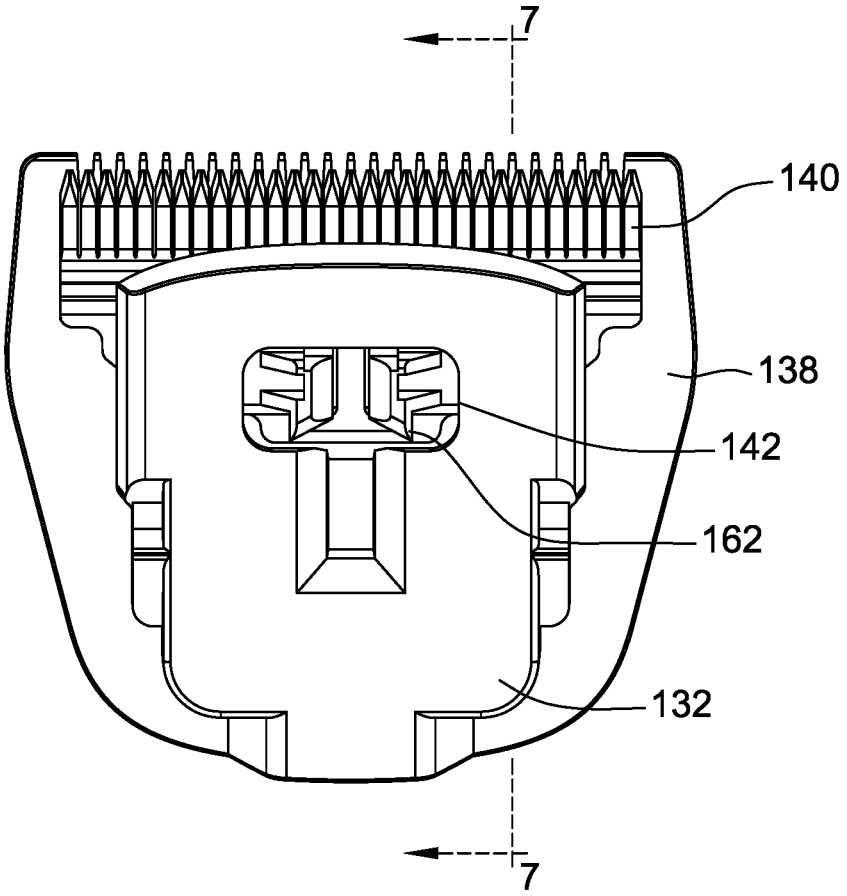
FIG. 6 is a bottom view of the head of FIG. 4.
Figure 7:
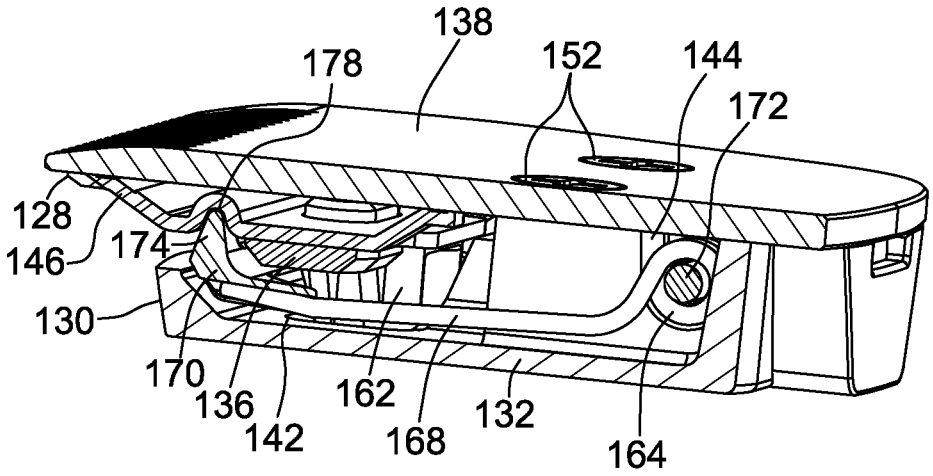
FIG. 7 is a cross-sectional view of the head of FIG. 4 taken along plane 7-7 of FIG. 6.

The neck 110 also includes a spring-loaded (or otherwise resilient) detent 122 that extends through the base 114 within a respective one of the channels 120 so as to be disposed beneath one of the ledges 118. As set forth in more detail below, the neck 110 is configured to support the head 104 on the handle 102 such that the head 104 is detachable from the handle 102 at an oblique angle relative to the longitudinal axis 106 of the handle 102. For example, in the illustrated embodiment, the head 104 may be manually ejected from the handle 102 using thumb-engageable push-panel 124 (shown in FIG. 4) of the head 104. Alternatively, the handle 102 may be provided with a thumb-actuated button for activating a spring-loaded ejection mechanism within the handle 102 to automatically eject the head 104 from the handle 102. In other embodiments, however, the handle 102 may have any suitable structure for attachment/detachment of the head 104 relative to the handle 102 in any suitable manner that facilitates enabling the appliance 100 to function as described herein.

In the illustrated embodiment, a drive mechanism 126 (e.g., an eccentric drive pin or translating drive pin) protrudes from within the handle 102 into the pocket 116 through the base 114. The drive mechanism 126 is configured for operative connection of the head 104 to the motor within the handle 102. Notably, the illustrated drive mechanism 126 is configured to facilitate attachment and detachment of the head 104 relative to the handle 102 at an oblique angle. In other embodiments, the drive mechanism 126 may be configured in any suitable manner that enables the appliance 100 to function as described herein.

As illustrated in FIGS. 4-7, the head 104 according to one embodiment suitably comprises a blade set 128 and a blade cartridge 130 by which the blade set 128 is supported on the handle 102. The blade cartridge 130 includes a blade frame 132, a biasing assembly (indicated generally by reference numeral 134), and a drive member 136. In one suitable embodiment, the blade cartridge 130 (e.g., the blade frame 132, the biasing assembly 134, and/or the drive member 136) or the neck 110 (e.g., the ledges 118 or other suitable structure of the neck 110 that contacts the head 104) are fabricated from a thermally conductive material (e.g., a metallic material such as aluminum) to facilitate heat transfer from the blade set 128 in the manner set forth in more detail below. As used herein, the term "blade" is not limited to a hair cutting member but, rather, broadly refers to a member configured for removing hair in any suitable manner such as, for example, a hair cutting member of an oscillating shaver, a hair cutting member of a rotary shaver, a toothed hair cutting member of a trimmer, a hair plucking member of an epilator, etc.

The illustrated blade set 128 includes a stationary blade 138 and a movable (or reciprocating) blade 140. The illustrated blade frame 132 includes a drive aperture 142, a spring slot 144, a pair of opposed spindle slots 146, a pair of fastener slots 148, and a pin slot 150. The stationary blade 138 is attached to the blade frame 132 via a pair of fasteners (e.g., screws 152) inserted into the fastener slots 148 of the blade frame 132. Moreover, the blade frame 132 comprises a pair of side rails 154 such that a space 156 is defined between each of the side rails 154 and the stationary blade 138 when the stationary blade 138 is attached to the blade frame 132, and each side rail 154 has a downwardly extending tab 158. Suitably, other embodiments of the head 104 may have the stationary blade 138 and the blade frame 132 configured in any suitable manner that facilitates enabling the head 104 to function as described herein.

The movable blade 140 is disposed generally longitudinally between the stationary blade 138 and the blade frame 132, and the movable blade 140 is seated on the drive member 136. The drive member 136 is disposed generally longitudinally between the movable blade 140 and the biasing assembly 134, and the drive member 136 includes at least one post 160 which engages the movable blade 140, as well as a follower 162 which engages the drive mechanism 126 of the handle 102 via the drive aperture 142 when the head 104 is attached to the handle 102, as set forth in more detail below.

The biasing assembly 134 includes a coil spring 164 having a locator tab 166 and a pair of arms 168, on which is seated a blade support 170. The locator tab 166 and the arms 168 are seated within the spring slot 144 of the blade frame 132 to locate the coil spring 164 on the blade frame 132, and a locator pin 172 is inserted through the coil spring 164 and into the pin slot 150 of the blade frame 132 to secure the coil spring 164 to the blade frame 132. The blade support 170 is seated on the arms 168 of the coil spring 164 and includes a pair of fingers 174 and a pair of spindles 176. Each spindle 176 is inserted into one of the spindle slots 146 of the blade frame 132 such that the blade support 170 is pivotably secured to the blade frame 132, and the fingers 174 are inserted into a groove 178 of the movable blade 140 to facilitate guiding oscillation of the movable blade 140 during operation of the appliance 100, as set forth below. In this manner, the movable blade 140, the drive member 136, and the biasing assembly 134 are all secured generally longitudinally between the stationary blade 138 and the blade frame 132. In other embodiments, the movable blade 140, the drive member 136, and the biasing assembly 134 may have any suitable components arranged in any suitable manner that facilitates enabling the head 104 to function as described herein.

With reference back to FIG. 3, to connect the head 104 to the handle 102, the head 104 is inserted into the pocket 116 of the handle 102 such that each side rail 154 of the blade frame 132 slides within one of the channels 120 of the neck 110 and such that, in some embodiments, the ledges 118 contact the underside of the stationary blade 138. When sliding the side rails 154 into the channels 120, the tabs 158 of the side rails 154 slide over the detents 122 of the neck 110, thereby depressing the detents 122 against their spring bias. After the side rails 154 traverse the detents 122, the detents 122 are permitted to spring back to being fully protruded from the base 114 in order to facilitate retaining the head 104 on the handle 102. With the head 104 retained on the handle 102 in such a manner, the follower 162 of the head 104 receives the drive mechanism 126 of the handle 102 so as to operably connect the movable blade 140 to the motor of the handle 102. In this manner, when the motor is powered, the drive mechanism 126 oscillates the movable blade 140 such that the movable blade 140 shearingly slides against the stationary blade 138. As desired, the head 104 may be detached from the handle 102 by sliding the head 104 out of the pocket 116 such that the tabs 158 of the blade frame 132 again depress the detents 122 of the neck 110 to permit complete removal of the head 104 from the handle 102.

One notable design parameter of the appliance 100 is the biasing force imparted on the movable blade 140 by the biasing assembly 134, in that the magnitude of the biasing force directly impacts the cutting effectiveness of the blades 138, 140. More specifically, an increase in the biasing force imparted on the movable blade 140 yields an increase in the overall cutting effectiveness of the head 104. However, another notable design parameter of the appliance 100 is the friction generated by the movable blade 140 sliding against the stationary blade 138. Generally speaking, as the biasing force imparted on the movable blade 140 increases, the friction (and heat) generated between the blades 138, 140 increases as well. In that regard, excessively heated blades 138, 140 may result in discomfort to the user and deformation of the blades 138, 140 over time. However, by actively removing heat from the blades 138, 140, the biasing force imparted to the movable blade 140 (and, therefore, the overall cutting effectiveness of the head 104) can be increased with less of a negative impact on the user experience and the structure of the blades 138, 140 over time.

Figure 8:
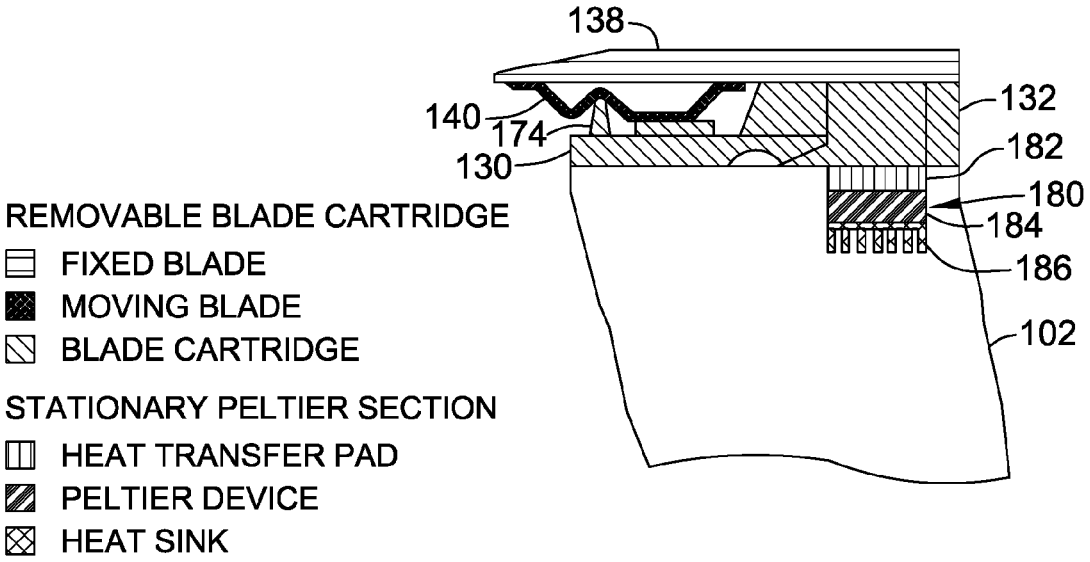
FIG. 8 is a schematic illustration of the appliance of FIG. 1 having a cooling system for removing heat from the head of FIG. 4.
Figure 9:
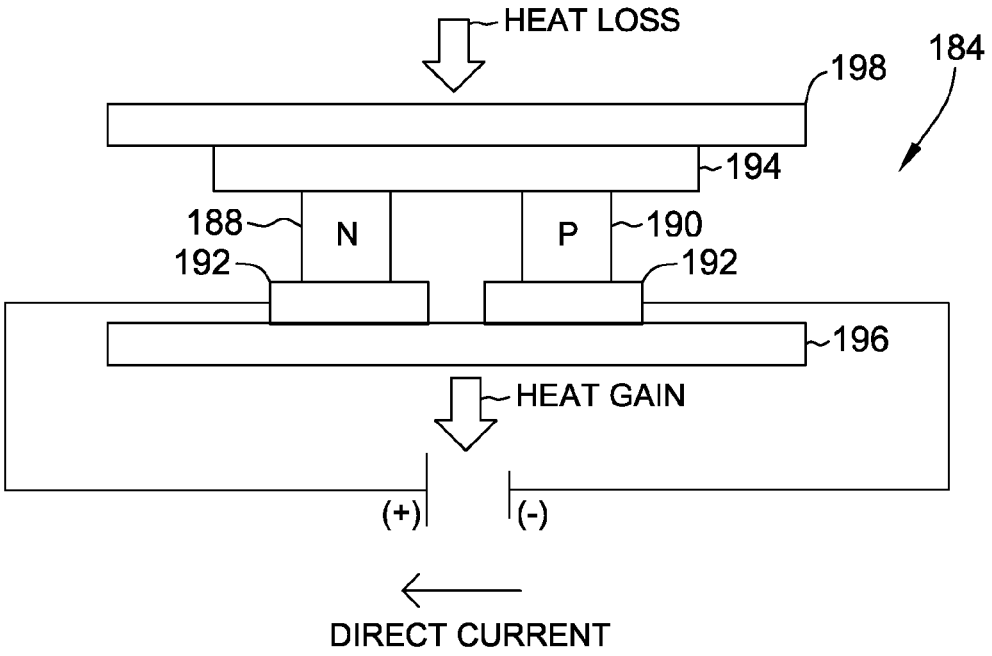
FIG. 9 is a schematic illustration of a thermoelectric cooling device of the cooling system of FIG. 8.

Referring now to FIGS. 8 and 9, the illustrated appliance 100 is provided with a cooling system (indicated generally by reference numeral 180) carried by the handle 102, and the cooling system 180 is configured for removing heat from the head 104 of the appliance, namely the blades 138, 140. The cooling system 180 comprises a heat transfer pad 182, a thermoelectric cooling device 184, and a heat sink 186. As set forth in more detail below, the cooling system 180 may also include a fan, which may be suitably powered either across an arrangement of gear(s) and shaft(s) by the motor which drives the movable blade 140 or by a separate motor housed within the handle 102.

With particular reference to FIG. 9, the thermoelectric cooling device 184 functions as a solid-state heat pump, utilizing the Peltier effect to transfer heat. Alternatively, the cooling device 184 may have any suitable thermoelectric heat transfer properties that enable the cooling system 180 to function as described herein. In the illustrated embodiment, the thermoelectric cooling device 184 comprises at least two semi-conductors, namely an N-type semi-conductor 188 and a P-type semi-conductor 190. The semi-conductors 188, 190 are disposed thermally in parallel, and electrically in series, with one another. More specifically, each semi-conductor 188, 190 is electrically connected to its own respective first conductor plate 192, and both semi-conductors 188, 190 are electrically connected to a common second conductor plate 194. The conductor plates 192, 194 (and, therefore, the semi-conductors 188, 190) are disposed between a pair of electrical insulator plates (e.g., ceramic plates), namely a first insulator plate 196 adjacent the first conductor plates 192, and a second insulator plate 198 adjacent the second conductor plate 194.

In the illustrated embodiment, the appliance 100 is configured for supplying power (e.g., direct current) to the first conductor plate 192 connected to the N-type semi-conductor 188. The current then flows through the N-type semi-conductor 188, and through the P-Type semi-conductor 190 via the second conductor plate 194. The current then flows from the P-type semi-conductor 190 through the first conductor plate 192 connected to the P-type semi-conductor 190. As the current flows through the semi-conductors 188, 190 and the conductor plates 192, 194, a temperature differential results between the second insulator plate 198 (i.e., the heat source side of the cooling device 184) and the first insulator plate 196 (i.e., the heat sink side of the cooling device 184). In this manner, heat is transferred from the second insulator plate 198 to the first insulator plate 196 when the current flows through the semi-conductors 188, 190 and the conductor plates 192, 194.

With reference again to FIG. 8, the cooling device 184 is situated in conductive heat transfer with (and between) the heat transfer pad 182 and the heat sink 186 such that the heat transfer pad 182 is adjacent the second insulator plate 198 and such that the heat sink 186 is adjacent the first insulator plate 196. Additionally, in the illustrated embodiment, the heat transfer pad 182 is situated in conductive heat transfer with the blade cartridge 130 (e.g., the blade frame 132), and the heat sink 186 is exposed to air contained within the handle 102. Optionally, the heat transfer pad 182 may also be situated in conductive heat transfer with the blade cartridge 130 by virtue of the ledges 118 of the neck 110 being in contact with the stationary blade 138. In this manner, when current flows through the cooling device 184 as set forth above, heat is transferred from the blade cartridge 130 to the heat sink 186 through the heat transfer pad 182, the second insulator plate 198, and the first insulator plate 196 by virtue of the cooling device 184.

During operation of the appliance 100, power is supplied to the motor within the handle 102. The motor drives the drive mechanism 126 within the pocket 116 of the handle 102 and, therefore, drives the movable blade 140 back-and-forth by virtue of the drive member 136, as set forth above. When the movable blade 140 slides against the stationary blade 138, friction is generated between the blades 138, 140, which in turn generates additional heat.

Meanwhile, power is also being supplied to the cooling system 180 such that current flows through the cooling device 184, as set forth above. The temperature differential generated by the cooling device 184 causes heat to be drawn from the movable blade 140 and/or the stationary blade 138 to the heat sink 186. Various thermal paths from the blades 138, 140 to the cooling system 180 are available such as, for example, through the blade cartridge 130 (e.g., the blade frame 132), or directly from the stationary blade 138 to the neck (e.g., via the ledges 118). Other suitable thermal paths are contemplated as well.

After the heat is transferred to the heat sink 186, the heat sink 186 then transfers the heat to the air within the handle 102 by convection. Optionally, as set forth above, the cooling system 180 may also include a fan for blowing air over the heat sink 186 to expedite the convection cooling of the heat sink 186 and cause the heat to be exhausted into the ambient air external to the handle 102 via a suitable vent provided on the handle 102. Alternatively, rather than actively exhausting the heat from the handle 102 using a fan, the cooling system 180 may utilize a passive exhaust system for exhausting heat from the handle 102, or a second, larger heat sink (e.g., a block of metal, a volume of liquid, etc.) contained within the handle 102 for absorbing the heat within the handle 102 rather than exhausting the heat from the handle 102. Suitably, a vent may be provided on the handle 102 without a fan for circulating air through the vent (e.g., ambient air may be permitted to flow freely through the vent without a fan facilitating the flow).

With such a cooling system 180, the magnitude of the biasing force imparted on the movable blade 140 may be increased given that the additional heat generated by the blades 138, 140 is removed by the cooling system 180. The result is increased cutting effectiveness, along with an improved user experience and increased longevity of the blades 138, 140. As set forth in more detail below, these benefits can be realized on various different types of grooming appliances.

Figure 10:
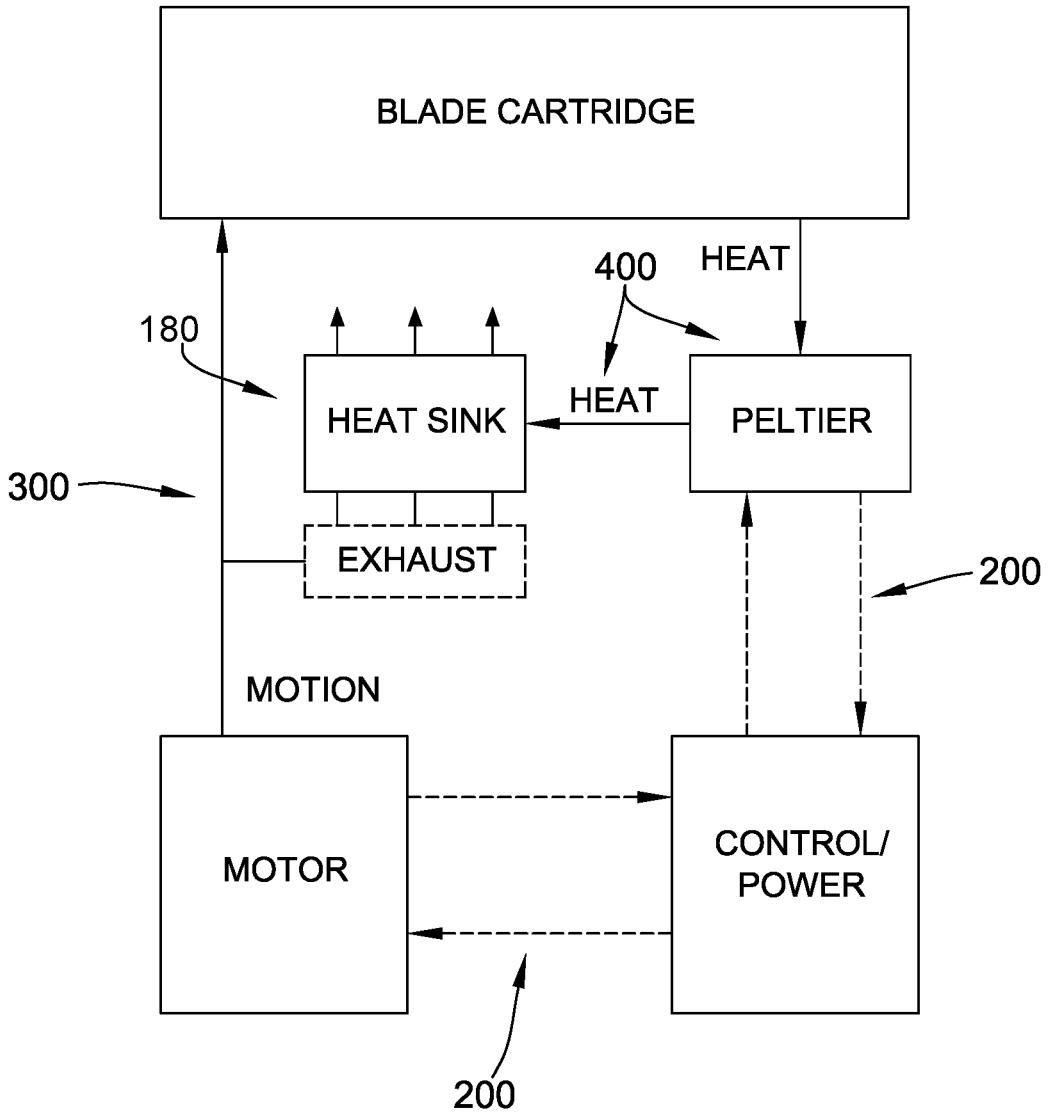
FIG. 10 is a schematic illustration of various electrical, mechanical, and thermal pathways of a hair grooming appliance utilizing an embodiment of the cooling system of FIG. 8.

FIG. 10 schematically illustrates mechanical, electrical, and thermal pathways which facilitate operation of an appliance having the cooling system 180. As illustrated, the appliance has a network of electrical energy pathways (indicated generally by the reference numeral 200) such as, for example, wires that transmit electrical energy from a source of electrical energy (e.g., the battery) to various components of the appliance which rely on electrical energy for operation (e.g., the motor and the cooling system). The appliance also has a network of mechanical energy pathways (indicated generally by reference numeral 300) such as, for example, drive gears and/or shafts for transmitting mechanical energy from a source of mechanical energy (e.g., the motor) to various components of the appliance which rely on mechanical energy for operation (e.g., a fan-based exhaust mechanism and the movable blade of the blade set).

The appliance further has a network of thermal energy pathways (indicated generally by the reference numeral 400) such as, for example, dedicated tracks of metal or carbon material (or heat pipes) for transmitting thermal energy from a source of thermal energy (e.g., the blade set) to the cooling system. In some contemplated embodiments, a suitable cooling fluid (liquid or gas) could also be pumped from a reservoir of the appliance through thermal pathways that are in the form of fluid conduits arranged in a cooling circuit to facilitate cooling the blade set in the manner described herein.

Figure 11:
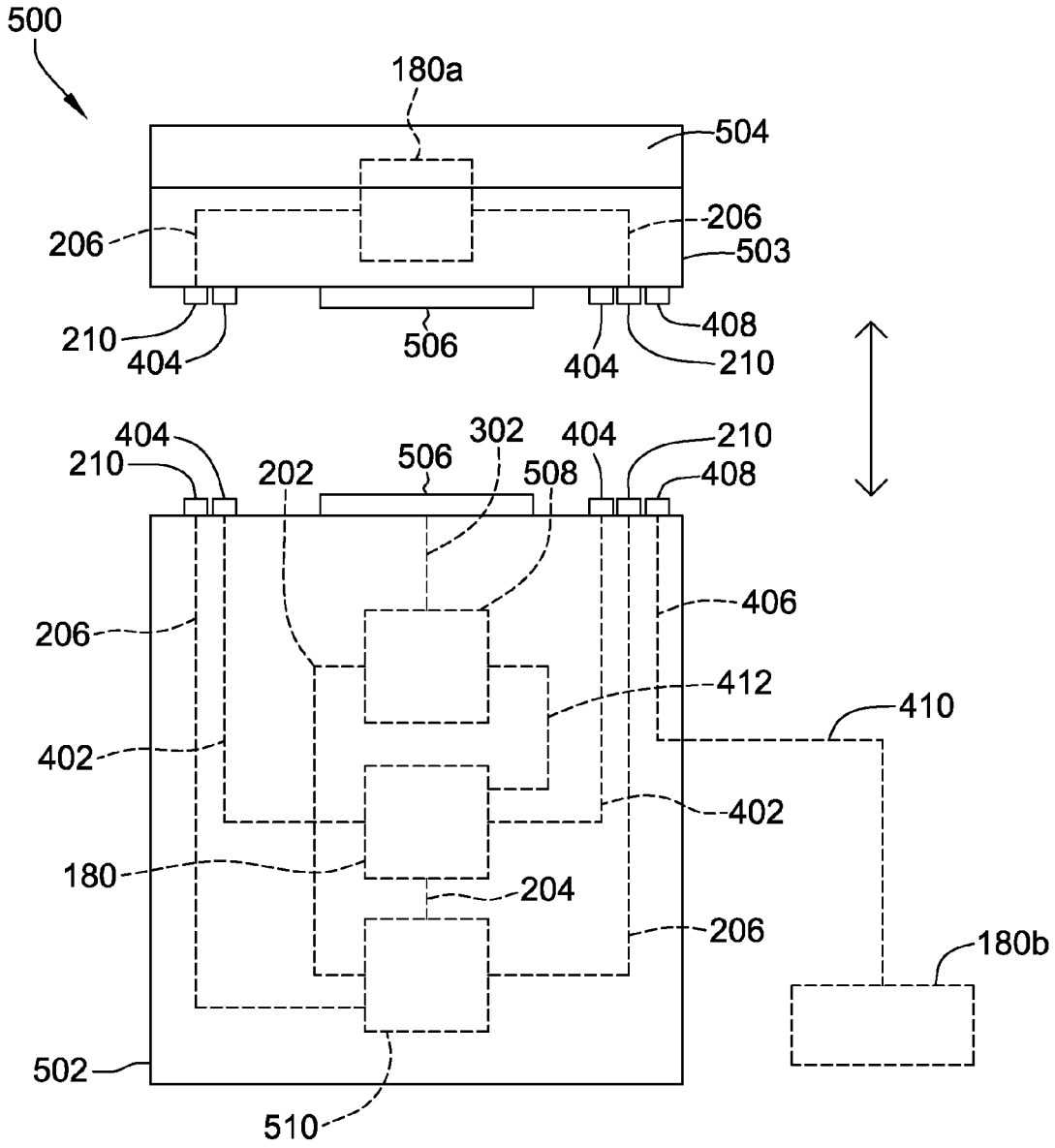
FIG. 11 is a schematic illustration of a hair-removal appliance utilizing embodiments of the cooling system of FIG. 8 and pathways similar to those illustrated in FIG. 10.

As mentioned above, while an electrical hair trimmer embodiment of an appliance is illustrated in FIGS. 1-7, it is contemplated that the cooling system 180 set forth herein would also be useful on other grooming appliances, such as at least the following hair-removal appliances: a reciprocating-type shaver having a blade cartridge with a foil blade; a rotary-type shaver with a blade cartridge having a cup-shaped, slotted blade; and an epilator with a blade cartridge (e.g., a rotating barrel) having blades for plucking hairs. In this manner, and for purposes of demonstrating some of the many contemplated implementations of the cooling system 180, FIG. 11 is provided as a schematic illustration of embodiments of the cooling system 180 and pathways 200, 300, 400 used with a hair-removal appliance 500 which may suitably be a trimmer, a reciprocating-type shaver, a rotary-type shaver, or an epilator, to name a few.

The appliance 500 has a handle 502 and a head 503 detachably coupled to the handle 502. Optionally, the head 503 may not be configured for detachment in other embodiments of the appliance 500. The illustrated head 503 has a blade set 504 with a suitable arrangement of movable and/or stationary blades to facilitate hair removal such as, for example: a rotary blade set having a stationary outer blade and a rotatable inner blade which is biased against and cooperates with the stationary outer blade to cut hair; an oscillating blade set having a stationary outer blade and a translatable inner blade which is biased against and cooperates with the stationary outer blade to cut hair; or an epilator blade set having a barrel-like arrangement of blades (e.g., metal or plastic disc-like structures) that cooperate with one another to pluck hair.

The blade set 504 may, in some embodiments, be carried on a suitable blade cartridge, and the blade set 504 may, in other embodiments, be removable from the head 503 (e.g., by removing the suitable blade cartridge from the head 503, for example). Additionally, the head 503 may have a suitable tray and/or other housing structure which defines a hair pocket therein for collecting hair removed by the blade set 504, and the head 503 may also have a suitable drive structure (e.g., drive gears and/or shafts) for driving the movable blade(s) of the blade set 504.

The illustrated handle 502 and head 503 each have a component of a suitable coupling structure 506 for detachable (or non-detachable) coupling of the head 503 to the handle 502. The handle 502 houses a motor 508 and, in one embodiment, a battery 510 for providing power to the motor 508 across first electrical energy pathway(s) 202, such that the motor 508 is operable to supply mechanical energy to the blade set 504 (e.g., the movable blade(s) of the blade set 504) across mechanical energy pathway(s) 302.

Optionally, the cooling system 180 may be housed within the handle 502 such that the cooling system 180 is powered by the battery 510 across second electrical energy pathway(s) 204, to render the cooling system 180 operable to remove heat from the blade set 504 (e.g., at least one movable and/or stationary blade of the blade set 504) across first thermal pathway(s) 402 via at least one thermally conductive terminal 404 situated at the interface of the head 503 and the handle 502. As shown in FIG. 11, the head 503 has a plurality of spaced-apart thermally conductive terminals 404, and the handle 502 has a plurality of corresponding thermally conductive terminals 404. When the head 503 is attached to the handle 502, the plurality of spaced-apart thermally conductive terminals 404 engages with the plurality of corresponding thermally conductive terminals 404 at an interface between the head 503 and the handle 502. In some embodiments, the cooling system 180 may be operable to remove heat from the drive system of the appliance 500 (e.g., from the motor 508) using another thermal pathway(s) 412 in addition to, or in lieu of, removing heat from the blade set 504 using the first thermal pathway(s) 402.

As shown in FIG. 11, another implementation of the cooling system 180 on the appliance 500 is to locate the cooling system 180, or at least one component 182, 184, 186 thereof, on the head 503 (as indicated by reference numeral 180*a*) such that the cooling system 180, or at least one of its components, is instead powered by the battery 510 across third electrical energy pathway(s) 206 across at least one electrically conductive terminal 210 situated at the interface of the head 503 and the handle 502. Notably, if componentry of the cooling system 180 is located on the head 503, the cooling device 184, for example, may be thermally coupled to the blade(s) across any suitable thermal pathway of the head 503 (e.g., the cooling system 180, or at least the components 182, 184, may be coupled directly to an interior or exterior surface of one or more of the blades of the blade set 504). Suitably, even if all or some of the cooling system 180 is on the handle 502, any suitable thermal pathways may be provided in the head 503 to facilitate cooling the blade set 504 as set forth herein. It should be noted that, for the trimmer embodiments of FIGS. 1-7 as well, the cooling system 180 may suitably be located at least in part on the head (e.g., to be detachable from the handle along with the head) in the manner of the appliance 500.

In yet another contemplated implementation, instead of locating the cooling system 180 on the appliance 500, the cooling system 180 (or at least one component thereof) may be located outside of the appliance 500 (as indicated by reference numeral 180*b*) such that the cooling system 180, or at last one of its components, is suitably powered by an external power source and is selectively connectable to the handle 502 for removing heat from the blade set 504 (e.g., at least one movable and/or stationary blade of the blade set 504) in the manner set forth herein and across third thermal pathway(s) 406 (e.g., a thermal pathway 406 in part provided by a cord 410 detachable from the handle 502) via at least one thermally conductive terminal 408 situated at the interface of the head 503 and the handle 502. In this manner, a more robust cooling system 180 may be utilized, in the sense that more space and more power are likely to be available outside of the appliance 500 as opposed to on the appliance 500. Such an exterior implementation of the cooling system 180 is equally applicable to embodiments of the appliance 100 as well.

When introducing elements of the present invention or the preferred embodiment(s) thereof, the articles "a", "an", "the", and "said" are intended to mean that there are one or more of the elements. The terms "comprising," "including", and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A grooming appliance comprising:

a handle;

a grooming head detachably disposed on the handle, wherein the grooming head generates heat during operation of the appliance;

a cooling system disposed at least in part within the handle, wherein the cooling system comprises a thermoelectric cooling device for removing heat from the grooming head during operation of the appliance;

the grooming head having a plurality of spaced-apart thermally conductive terminals, and the handle having a plurality of corresponding thermally conductive terminals; and wherein when the grooming head is attached to the handle, the plurality of spaced-apart thermally conductive terminals engages with the plurality of corresponding thermally conductive terminals at an interface between the grooming head and the handle.

2. An electric hair grooming appliance comprising:

a handle;

a motor housed within the handle;

a head detachably disposed on the handle, wherein the head comprises a blade set having a plurality of blades that cooperate to remove hair, at least one of the blades being operatively connected to the motor;

a cooling system disposed at least in part within the handle, wherein the cooling system comprises a thermoelectric cooling device for removing heat from the blade set during operation of the appliance;

the head having a plurality of spaced-apart thermally conductive terminals, and the handle having a plurality of corresponding thermally conductive terminals; and wherein when the head is attached to the handle, the plurality of spaced-apart thermally conductive terminals engages with the plurality of corresponding thermally conductive terminals at an interface between the head and the handle.

3. The electric hair grooming appliance set forth in claim 2 wherein the thermoelectric cooling device is a Peltier device.

4. The electric hair grooming appliance set forth in claim 2 wherein the cooling system includes a heat sink situated in conductive heat transfer with the thermoelectric cooling device and disposed within the handle.

5. The electric hair grooming appliance set forth in claim 4 wherein the cooling system comprises a fan for exhausting heat from the handle.

6. The electric hair grooming appliance set forth in claim 2 wherein the cooling system includes a pad situated in conductive heat transfer between the blade set and the thermoelectric cooling device.

7. The electric hair grooming appliance set forth in claim 2 wherein the cooling system is completely contained within the handle.

8. The electric hair grooming appliance set forth in claim 2 wherein the appliance is an epilator such that the blades are configured for plucking hair.

9. The electric hair grooming appliance set forth in claim 2 wherein the appliance is a reciprocating shaver such that one of the blades is a foil blade.

10. The electric hair grooming appliance set forth in claim 2 wherein the appliance is a rotary shaver such that one of the blades is a cup-shaped, slotted blade.

11. The electric hair grooming appliance set forth in claim 2 wherein the appliance is a trimmer, the blades comprising a toothed stationary blade and a toothed movable blade.

12. The electric hair grooming appliance set forth in claim 11 wherein the head comprises a blade cartridge for supporting the blade set on the handle.

13. The electric hair grooming appliance set forth in claim 12 wherein the blade cartridge comprises a blade frame to which the stationary blade is fastened such that the movable blade is secured between the stationary blade and the blade frame.

14. The electric hair grooming appliance set forth in claim 13 wherein the head and the handle are configured for manual ejection of the head from the handle.

15. The electric hair grooming appliance set forth in claim 13 wherein the head and the handle are configured for automatic ejection of the head from the handle.

16. The electric hair grooming appliance set forth in claim 13 wherein the blade cartridge comprises a biasing element for biasing the movable blade against the stationary blade.

17. The electric hair grooming appliance set forth in claim 16 wherein the biasing element is a coil spring.

18. The electric hair grooming appliance set forth in claim 17 wherein the blade cartridge comprises a blade support disposed between the biasing element and the movable blade, the blade support comprising a follower for oscillating the movable blade.

19. The electric hair grooming appliance set forth in claim 18 wherein the movable blade comprises a groove, and the blade support comprises a finger inserted into the groove to facilitate guiding oscillation of the movable blade.

20. An electric hair grooming appliance comprising:

a handle;

a motor housed within the handle;

a head detachably connected to the handle, wherein the head comprises a blade set and a blade cartridge configured to support the blade set on the handle, the blade set comprising a toothed stationary blade and a toothed movable blade arranged in sliding, face-to-face contact with the stationary blade, wherein the blade cartridge comprises:

a blade frame to which the stationary blade is fastened;

a drive member on which the movable blade is seated, wherein the drive member comprises a follower configured to drive the movable blade into oscillation when the appliance is operated; and a biasing assembly configured to bias the movable blade and the drive member toward the stationary blade, wherein the biasing assembly comprises a spring and a blade support seated on the spring for engaging the movable blade and guiding oscillation of the movable blade such that the movable blade, the drive member, and the biasing assembly are secured between the stationary blade and the blade frame; and a cooling system comprising a heat sink and a Peltier device situated in conductive heat transfer with the heat sink and with at least one of the motor and the blade set such that the Peltier device is configured to transfer heat from the at least one of the motor and the blade set to the heat sink during operation of the appliance;

the head having a plurality of spaced-apart thermally conductive terminals, and the handle having a plurality of corresponding thermally conductive terminals; and wherein when the head is attached to the handle, the plurality of spaced-apart thermally conductive terminals engages with the plurality of corresponding thermally conductive terminals at an interface between the head and the handle.

* * * * *